US010672545B2

(12) United States Patent
Masusawa et al.

(10) Patent No.: US 10,672,545 B2
(45) **Date of Patent: *Jun. 2, 2020**

(54) R-T-B BASED PERMANENT MAGNET

(71) Applicant: TDK CORPORATION, Tokyo (JP)

(72) Inventors: Kiyoyuki Masusawa, Tokyo (JP); Makoto Nakane, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/833,502

(22) Filed: Dec. 6, 2017

(65) Prior Publication Data

US 2018/0158583 A1 Jun. 7, 2018

(30) Foreign Application Priority Data

Dec. 6, 2016 (JP) ..... 2016-237153
Dec. 5, 2017 (JP) ..... 2017-233833

(51) Int. Cl.

| | |
|---|---|
| ***H01F 1/057*** | (2006.01) |
| ***C22C 38/16*** | (2006.01) |
| ***C22C 38/14*** | (2006.01) |
| ***C22C 38/10*** | (2006.01) |
| ***C22C 38/04*** | (2006.01) |
| ***C22C 38/00*** | (2006.01) |
| ***C22C 38/06*** | (2006.01) |
| ***C22C 38/08*** | (2006.01) |
| ***C22C 33/02*** | (2006.01) |
| *B22F 1/00* | (2006.01) |

(52) U.S. Cl.

CPC ..... *H01F 1/057* (2013.01); *C22C 33/025* (2013.01); *C22C 38/001* (2013.01); *C22C 38/002* (2013.01); *C22C 38/005* (2013.01); *C22C 38/04* (2013.01); *C22C 38/06* (2013.01); *C22C 38/08* (2013.01); *C22C 38/10* (2013.01); *C22C 38/14* (2013.01); *C22C 38/16* (2013.01); *H01F 1/0577* (2013.01); *B22F 1/0014* (2013.01); *B22F 2999/00* (2013.01); *C22C 2202/02* (2013.01)

(58) Field of Classification Search

None

See application file for complete search history.

(56) References Cited

U.S. PATENT DOCUMENTS

| | | | | |
|---|---|---|---|---|
| 2008/0245442 | A1 | 10/2008 | Nakamura et al. | |
| 2009/0297699 | A1* | 12/2009 | Baba | H01F 41/026 427/127 |
| 2010/0233016 | A1* | 9/2010 | Tsubokura | C22C 33/0278 420/83 |
| 2011/0025440 | A1* | 2/2011 | Kuniyoshi | C22C 33/0278 335/302 |
| 2011/0150691 | A1 | 6/2011 | Nakamura et al. | |
| 2013/0026870 | A1* | 1/2013 | Baba | C22C 38/005 310/152 |
| 2015/0059525 | A1* | 3/2015 | Sagawa | B22F 3/24 75/246 |
| 2015/0170810 | A1* | 6/2015 | Miwa | C22C 38/001 75/246 |
| 2016/0012946 | A1* | 1/2016 | Horikita | C22C 33/0278 419/31 |
| 2016/0042847 | A1* | 2/2016 | Nishiuchi | C22C 38/001 335/302 |

FOREIGN PATENT DOCUMENTS

| | | | | |
|---|---|---|---|---|
| EP | 0345092 | A1 | 12/1989 | |
| EP | 1467385 | A1 | 10/2004 | |
| EP | 1562203 | A1 | 8/2005 | |
| EP | 2226137 | A1 | 9/2010 | |
| JP | H04-006806 | A | 1/1992 | |
| JP | 2003-257721 | A | 9/2003 | |
| JP | 2003-257768 | A | 9/2003 | |
| JP | 2006-210893 | A | 8/2006 | |
| WO | 2006/043348 | A1 | 4/2006 | |
| WO | WO-2013191276 | A1 * | 12/2013 | C22C 38/001 |

* cited by examiner

*Primary Examiner* — Xiaowei Su

(74) *Attorney, Agent, or Firm* — Oliff PLC

(57) ABSTRACT

An object of the present invention is to provide an R-T-B based permanent magnet showing high residual magnetic flux density Br and coercive force HcJ, and further showing the same also after heavy rare earth element is diffused along grain boundaries. Provided is an R-T-B based permanent magnet in which, R is a rare earth element, T is an element other than the rare earth element, B, C, O or N, and B is boron. T at least includes Fe, Cu, Co and Ga, and a total of R content is 28.0 to 30.2 mass %, Cu content is 0.04 to 0.50 mass %, Co content is 0.5 to 3.0 mass %, Ga content is 0.08 to 0.30 mass %, and B content is 0.85 to 0.95 mass %, relative to 100 mass % of a total mass of R, T and B.

26 Claims, No Drawings

R-T-B BASED PERMANENT MAGNET

BACKGROUND OF THE INVENTION

1. Field of the Invention

The present invention relates to an R-T-B based permanent magnet.

2. Description of the Related Art

Rare earth permanent magnet having an R-T-B based composition is a magnet showing superior magnetic properties, and many investigations aiming for further improvement of the magnetic properties are being performed. Indexes for expressing the magnetic properties are generally residual magnetic flux density (residual magnetization) Br and coercive force HcJ. Magnet having high values thereof is determined to have superior magnetic properties.

For instance, Patent Document 1 mentions an Nd—Fe—B based rare earth permanent magnet having good magnetic properties.

In addition, Patent Document 2 mentions a rare earth permanent magnet, in which a magnet body is immersed in slurry in which fine powder including rare earth element is dispersed in water or organic solvent, heated thereof, and the rare earth element is diffused into the magnet body along the grain boundaries.

Patent Document 1: JP 2006-210893A

Patent Document 2: a brochure of WO 2006/43348

DISCLOSURE OF THE INVENTION

Means for Solving the Problems

An object of the present invention is to provide an R-T-B based permanent magnet showing high residual magnetic flux density Br and coercive force HcJ, and further showing the same also after grain boundary diffusion of a heavy rare earth element.

In order to achieve the above object, the R-T-B based permanent magnet of the invention provides, an R-T-B based permanent magnet in which, "R" is a rare earth element, "T" is an element other than the rare earth element, "B", "C", "O" or "N", and "B" is boron, "T" at least includes Fe, Cu, Co and Ga, and a total of "R" content is 28.0 to 30.2 mass %, Cu content is 0.04 to 0.50 mass %, Co content is 0.5 to 3.0 mass %, Ga content is 0.08 to 0.30 mass %, and "B" content is 0.85 to 0.95 mass %, relative to 100 mass % of a total mass of "R", "T" and "B".

The R-T-B based permanent magnet of the invention can improve residual magnetic flux density Br and coercive force HcJ by showing the characteristics above. In addition, effects obtained by the grain boundary diffusion of a heavy rare earth element can be further heightened. In concrete, residual magnetic flux density Br and coercive force HcJ of R-T-B based permanent magnet obtained after the heavy rare earth element is diffused can also be heightened.

The total of "R" content may be 29.2 to 30.2 mass %.

"R" may include at least Nd.

"R" may include at least Pr. Pr content may be more than zero to 10.0 mass % or less.

"R" may include at least Nd and Pr.

"T" may further include Al. Al content may be 0.15 to 0.30 mass %.

"T" may further include Zr. Zr content may be 0.10 to 0.30 mass %.

The R-T-B based permanent magnet may further include "C". "C" content may be 1100 ppm or less relative to a total mass of the R-T-B based permanent magnet.

The R-T-B based permanent magnet may further include "N". "N" content may be 1000 ppm or less relative to the total mass of the R-T-B based permanent magnet.

The R-T-B based permanent magnet may further include "O". "O" content may be 1000 ppm or less relative to the total mass of the R-T-B based permanent magnet.

An atomic ratio of TRE/B may be 2.2 to 2.7, where TRE is a total of R content.

An atomic ratio of 14B/(Fe+Co) may be more than zero and 1.01 or less.

A concentration of the heavy rare earth element may be reduced from outside to inside of the magnet body.

DESCRIPTION OF THE PREFERRED EMBODIMENTS

An embodiment of the invention will be described hereinafter.

<R-T-B Based Permanent Magnet>

R-T-B based permanent magnet according to the embodiment includes grains made of $R_2T_{14}B$ crystals and grain boundaries thereof. Residual magnetic flux density Br, coercive force HcJ, corrosion resistance and production stability can be improved by including a plural number of specific elements within a specified range of their content. In addition, reduction rate of the residual magnetic flux density Br at the latter mentioned grain boundary diffusion process can be made small, while increase rate of the coercive force HcJ can be made large. Namely, R-T-B based permanent magnet according to the present embodiment shows superior properties even without the grain boundary diffusion process, and also, said R-T-B based permanent magnet is suitable for the grain boundary diffusion process. Considering improvement of the coercive force HcJ, the element diffused along the grain boundaries is preferably the heavy rare earth element.

"R" is the rare earth element. The rare earth element includes Sc, Y and lanthanoids, which belongs to the group III in the long-periodic table. Lanthanoids include such as La, Ce, Pr, Nd, Sm, Eu, Gd, Tb, Dy, Ho, Er, Tm, Yb and Lu. In addition, Nd is preferably included as "R".

The rare earth elements are generally classified as light rare earth elements and heavy rare earth elements. Heavy rare earth elements of R-T-B based permanent magnet according to the present embodiment are Gd, Tb, Dy, Ho, Er, Tm, Yb and Lu.

"T" is an element other than the rare earth element, B, C, O or N. The R-T-B based permanent magnet according to the present embodiment at least includes Fe, Co, Cu and Ga as "T". One or more kinds of elements among the elements such as Al, Mn, Zr, Ti, V, Cr, Ni, Nb, Mo, Ag, Hf, Ta, W, Si, P, Bi, Sn can be further included as "T".

"B" is boron.

A total of "R" content in the R-T-B based permanent magnet of the present embodiment is 28.0 mass % or more to 30.2 mass % or less, relative to 100 mass % of a total mass of R, T and B. In case when the total of "R" content is too small, the coercive force HcJ decreases. In case when the total of "R" content is too large, the residual magnetic flux density Br decreases. The total of "R" content may be 29.2 to 30.2 mass %. When the total of "R" content is 29.2 mass % or more and degree of deformation during sintering process becomes less and, thus production stability improves.

The R-T-B based permanent magnet according to the present embodiment includes Nd in an optional content. Nd content may be zero to 30.2 mass %, zero to 29.7 mass %, 19.7 to 29.7 mass %, 19.7 to 24.7 mass % or 19.7 to 22.6 mass %, relative to 100 mass % of a total mass of "R", "T" and "B". Pr content may be zero to 10.0 mass %. Namely, Pr may not be included. The R-T-B based permanent magnet according to the present embodiment may at least include Nd and Pr as "R". Pr content may be 5.0 mass % or more and 10.0 mass % or less, and further, it may be 5.0 mass % or more and 7.6 mass % or less. In case when Pr content is 10.0 mass % or less, temperature coefficient of the coercive force HcJ is superior. In particular, to improve the coercive force HcJ at high temperature, Pr content is preferably zero to 7.6 mass %.

In addition, R-T-B based permanent magnet according to the present embodiment may include 0.5 mass % or less in total of Tb and/or Dy as "R". It becomes easy to keep good residual magnetic flux density when the total of Tb and/or Dy content is 0.5 mass % or less.

Cu content is 0.04 mass % or more and 0.50 mass % or less relative to 100 mass % of the total mass of "R", "T" and "B". Coercive force HcJ tends to decrease when Cu content is less than 0.04 mass %. In addition, improvement rate ΔHcJ of the coercive force HcJ by the diffusion of heavy rare earth element (namely, by applying the grain boundary diffusion process) becomes insufficient, and the coercive force HcJ after the diffusion of heavy rare earth element tends to decrease. Coercive force HcJ tends to decrease when Cu content exceeds 0.50 mass %, and residual magnetic flux density Br also tends to decrease. In addition, improvement rate ΔHcJ of the coercive force HcJ by the diffusion of heavy rare earth element may be saturated and residual magnetic flux density Br tends to decrease. In addition, Cu content may be 0.10 mass % or more and 0.50 mass % or less, and may be 0.10 mass % or more and 0.30 mass % or less. The corrosion resistance tends to improve by making Cu content 0.10 mass % or more.

Ga content is 0.08 mass % or more and 0.30 mass % or less relative to 100 mass % of the total mass of "R", "T" and "B". Coercive force HcJ sufficiently increases when Ga content is 0.08 mass % or more. A sub-phase, such as an R-T-Ga phase, tends to form and residual magnetic flux density Br tends to decrease when Ga content exceeds 0.30 mass %. In addition, Ga content may be 0.10 mass % or more and 0.25 mass % or less.

Co content is 0.5 mass % or more and 3.0 mass % or less relative to 100 mass % of the total mass of "R", "T" and "B". The corrosion resistance improves by including Co. The corrosion resistance of the finally obtained R-T-B based permanent magnet deteriorates when Co content is less than 0.5 mass %. Improvement effects of the corrosion resistance saturate and incur a high cost when Co content exceeds 3.0 mass %. Co content may be 1.0 mass % or more and 3.0 mass % or less.

Al content is 0.15 mass % or more and 0.30 mass % or less relative to 100 mass % of the total mass of "R", "T" and "B". In case when Al content is 0.15 mass % or more, coercive force HcJ before and after the diffusion of the heavy rare earth element can be increased. In addition, difference of the magnetic properties, especially coercive force HcJ, due to changes of aging temperature and/or heat treatment temperature after the diffusion of the heavy rare earth element become small, and the properties variance during mass production becomes small. Namely, the production stability improves. Residual magnetic flux density Br before and after the diffusion of the heavy rare earth element can be improved when Al content is 0.30 mass % or less. The temperature coefficient of coercive force HcJ can also be improved. Al content may be 0.15 mass % or more and 0.25 mass % or less. Difference of the magnetic properties, especially coercive force HcJ, due to changes of the aging temperature and/or the heat treatment temperature after the diffusion of the heavy rare earth element, become further small when Al content is 0.15 mass % or more and 0.25 mass % or less.

Zr content is 0.10 mass % or more and 0.30 mass % or less relative to 100 mass % of the total mass of "R", "T" and "B". Abnormal grain growth during sintering can be prevented and squareness ratio Hk/HcJ and magnetization ratio under a low magnetic field can be improved by including Zr. By making Zr content 0.10 mass % or more, the abnormal grain growth preventing effect during sintering by including Zr is enhanced, and the squareness ratio Hk/HcJ and the magnetization ratio under a low magnetic field can be improved. By making Zr content 0.30 mass % or less, the residual magnetic flux density Br can be improved. Zr content may be 0.15 mass % or more and 0.30 mass % or less, and may be 0.15 mass % or more and 0.25 mass % or less. By making Zr content 0.15 mass % or more, optimal temperature range for the sintering becomes wide. Namely, the abnormal grain growth preventing effect during sintering is further enhanced. Variations of the properties become small and production stability improves.

In addition, R-T-B based permanent magnet according to the present embodiment may include Mn. In case of including Mn, Mn content may be 0.02 mass % to 0.10 mass % relative to 100 mass % of the total mass of "R", "T" and "B". By making Mn content 0.02 mass % or more, the residual magnetic flux density Br tends to increase and the improvement rate ΔHcJ of coercive force HcJ by diffusing heavy rare earth element tends to increase. By making Mn content 0.10 mass % or less, the coercive force HcJ tends to increase, and the improvement rate ΔHcJ of coercive force HcJ by diffusing heavy rare earth element tends to increase. Mn content may be 0.02 mass % or more and 0.06 mass % or less.

"B" content in R-T-B based permanent magnet according to the present embodiment is 0.85 mass % or more to 0.95 mass % or less, relative to 100 mass % of the total mass of "R", "T" and "B". It becomes difficult to realize high squareness when "B" content is less than 0.85 mass %. Namely, it becomes difficult to enhance squareness ratio Hk/HcJ. The squareness ratio Hk/HcJ after the grain boundary diffusion tends to decrease when "B" content exceeds 0.95 mass %. "B" content may be 0.88 mass % or more and 0.94 mass % or less. Residual magnetic flux density Br tends to increase further more when "B" content is 0.88 mass % or more. Coercive force HcJ tends to increase further more when "B" content is 0.94 mass % or less.

An atomic ratio of TRE/B may be 2.2 or more and 2.7 or less, where TRE is a total of "R" element content. The atomic ratio of TRE/B may be 2.29 or more and 2.63 or less, 2.32 or more and 2.63 or less, 2.34 or more and 2.59 or less, 2.34 or more and 2.54 or less, and 2.36 or more and 2.54 or less. The residual magnetic flux density and coercive force HcJ tend to increase when TRE/B is within the above range.

In addition, an atomic ratio of 14B/(Fe+Co) may be more than zero to 1.01 or less. Squareness ratio after the grain boundary diffusion tends to increase when 14B/(Fe+Co) is 1.01 or less. 14B/(Fe+Co) may be 1.00 or less.

Carbon, "C", content in R-T-B based permanent magnet according to the present embodiment relative to a total mass of the R-T-B based permanent magnet may be 1100 ppm or less, 1000 ppm or less, and 900 ppm or less. It may further be 600 to 1100 ppm, 600 to 1000 ppm, or 600 to 900 ppm. Coercive force HcJ before and after the diffusion of the heavy rare earth element tends to increase when carbon content is 1100 ppm or less. In particular, considering improving coercive force HcJ after the diffusion of the heavy rare earth element, carbon content can be 900 ppm or less. Production of R-T-B based permanent magnet in which carbon content is less than 600 ppm makes process conditions of the R-T-B based permanent magnet severe, which becomes a factor of increasing cost.

Specially, considering improving squareness ratio after the diffusion of heavy rare earth element, carbon content may be 800 to 1100 ppm.

Nitrogen, "N", content in R-T-B based permanent magnet according to the present embodiment relative to a total mass of the R-T-B based permanent magnet may be 1000 ppm or less, 700 ppm or less, or 600 ppm or less. "N" content may be 250 to 1000 ppm, 250 to 700 ppm, or 250 to 600 ppm. Coercive force HcJ tends to become larger as nitrogen content is less. Production of R-T-B based permanent magnet in which nitrogen content is less than 250 ppm makes process conditions of the R-T-B based permanent magnet severe, which becomes a factor of increasing cost.

Oxygen, "O", content in R-T-B based permanent magnet according to the present embodiment relative to a total mass of the R-T-B based permanent magnet may be 1000 ppm or less, 800 ppm or less, 700 ppm or less, or 500 ppm or less. It may be 350 to 500 ppm. Coercive force HcJ before the diffusion of the heavy rare earth element tends to increase as oxygen content is less. Production of R-T-B based permanent magnet in which oxygen content is less than 350 ppm makes process conditions of the R-T-B based permanent magnet severe, which becomes a factor of increasing cost.

In addition, by making "R" content 29.2 mass % or more, and the oxygen content 1000 ppm or less, 800 ppm or less, 700 ppm or less or 500 ppm or less, deformation during sintering can be prevented and the production stability can be improved.

Following reasons can be considered for preventing deformation during sintering by making the total of "R" content within a predetermined amount or more and decreasing the oxygen content. The sintering mechanism of an R-T-B based permanent magnet is liquid phase sintering, in which grain boundary phase component called R-rich phase melts to form liquid phase during sintering and promotes densification. On the other hand, "O" is reactive to the R-rich phase, and rare earth oxide phase is formed more when "O" amount increases and the R-rich phase amount decreases. Although in a very small quantity, oxidizing impurity gas generally exists in a sintering furnace. Therefore, during the sintering process, the R-rich phase oxidizes near the surface of a green compact, and the R-rich phase amount may locally decrease. With the composition having large total "R" content and less "O" amount, the R-rich phase amount is large, and an influence of the oxidation on the shrinking behavior during sintering becomes small. With the composition having less "R" content and/or large "O" amount, the oxidization during sintering affects the shrinking behavior during sintering because the R-rich phase amount becomes less. As a result, a sintered body is deformed by partial change in shrinkage, namely, partial size change. Thus, deformation during sintering can be prevented by making a total amount of "R" to a prescribed amount or larger and by decreasing "O" content.

A measuring method of components of various kinds included in an R-T-B based permanent magnet according to the present embodiment can be a conventionally and generally known method. Amounts of various kinds of elements can be measured by such as X-ray fluorescence analysis, inductively coupled plasma atomic emission spectroscopy (ICP analysis), and etc. Oxygen content is measured by such as inert gas fusion-nondispersive infrared absorption method. Carbon content is measured by such as combustion in oxygen stream-infrared absorption method. Nitrogen content is measured by such as inert gas fusion-thermal conductivity method.

R-T-B based permanent magnet according to the present embodiment has an optional shape. For instance, a rectangular parallelepiped shape can be exemplified.

Hereinafter, a manufacturing method of R-T-B based permanent magnet can be described in detail, however, the other known methods can be used.

[Preparation Process of Raw Material Powder]

Raw material powder can be prepared by a well-known method. Single alloy method using a single alloy will be described in the present embodiment; however, it can be what is called two alloys method, in which the first and the second alloys mutually having different composition are mixed to prepare raw material powder.

First, a raw material alloy of R-T-B based permanent magnet is prepared (an alloy preparation process). In the alloy preparation process, a raw material alloy having desired composition is prepared by melting the raw material metals corresponding to a composition of the R-T-B based permanent magnet of the embodiment by a well-known method, and subsequently casting thereof.

Rare earth metal, rare earth alloy, pure iron, ferroboron, metal such as Co or Cu, alloy thereof, compound thereof, and etc. can be used as the raw material metal. Casting method in which the raw material alloy is casted from the raw material metal can be an optional method. A strip cast method can be used to obtain the R-T-B based permanent magnet having higher magnetic properties. A homogenizing treatment can be performed to the obtained raw material alloy by a well-known method when necessary.

After preparing the raw material alloy, it is pulverized (pulverization process). Note, an atmosphere of each process from the pulverization process to the sintering process can be a low oxygen concentration in the atmosphere in view of obtaining higher magnetic properties. For instance, the oxygen concentration in each process can be 200 ppm or less. By controlling the oxygen concentration in each process, an oxygen amount included in the R-T-B based permanent magnet can be controlled.

Hereinafter, the pulverization process of a two-step process including a coarse pulverization process, in which the raw material alloy is pulverized till the particle diameter becomes approximately several hundreds μm to several mm, and a fine pulverization process, in which the particle diameter becomes approximately several am, are described; however, said pulverization process can be one-step process only including the fine pulverization process.

In the coarse pulverization process, the raw material alloy is coarsely pulverized till the particle diameter becomes approximately several hundreds μm to several mm. Coarsely pulverized powder is then obtained. The coarse pulverization method can be an optional method, and it can be a well-known method such as a hydrogen storage pulverization method, a method using a coarse pulverizer, and etc. In case of performing the hydrogen storage pulverization, nitrogen amount included in R-T-B based permanent magnet can be controlled by controlling nitrogen gas concentration in an atmosphere when dehydrogenation treated.

Next, the obtained coarsely pulverized powder is finely pulverized till the average particle diameter becomes approximately several μm (a fine pulverization process). Therefore fine pulverized powder, namely raw material powder, is obtained. Average particle diameter of the fine pulverized powder may be 1 μm or more and 10 μm or less, 2 μm or more and 6 μm or less or 3 μm or more and 5 μm or less. Nitrogen amount included in R-T-B based permanent magnet can be controlled by controlling nitrogen gas concentration in an atmosphere during the fine pulverization process.

The fine pulverization method can be an optional method. For instance, various kinds of the fine pulverizer can be used for the fine pulverization.

In the fine pulverization process of coarsely pulverized powder, fine pulverized powder with high orientation when compacting can be obtained by the addition of various pulverization aids such as lauramide, oleyamide, and etc. In addition, the carbon amount included in R-T-B based permanent magnet can be controlled by varying amount of the pulverization aid added.

[Compacting Process]

In the compacting process, the above-mentioned fine pulverized powder is compacted to a desired shape. Compacting can be performed in an optional method. According to the present embodiment, the fine pulverized powder above is filled in a die and compressed in a magnetic field. According to thus obtained green compact, main phase crystals are oriented in a specific direction. Therefore, the R-T-B based permanent magnet having higher residual magnetic flux density can be obtained.

Compaction pressure may be 20 MPa to 300 MPa. Applied magnetic field may be 950 kA/m or more, or may be 950 kA/m to 1,600 kA/m. The applied magnetic field is not limited to a static magnetic field, and can be a pulse magnetic field. In addition, the static magnetic field and the pulse magnetic field can be combinedly used.

Note, as the compacting process, a wet compacting, which compacts slurry in which fine pulverized powder is dispersed in a solvent such as oil, can be used in addition to the above-mentioned dry compacting, which compacts the fine pulverized powder as it is.

A shape of the green compact obtained by compacting the fine pulverized powder can be an optional shape. In addition, density of the green compact at this point can be 4.0 $Mg/m^3$ to 4.3 $Mg/m^3$.

[Sintering Process]

Sintering process is a process in which the green compact is sintered in a vacuum or in an inert gas atmosphere and a sintered body is obtained. Although sintering temperature is required to be adjusted corresponding to conditions, such as the composition, the pulverization method, the particle size and the particle size distribution, a firing is processed by heating the green compact such as in vacuum or under inert gas, at 1,000° C. or more to 1,200° C. or less and for one hour or more to 20 hours or less. Thus, the sintered body with high density can be obtained. In the present embodiment, the sintered body having the density of 7.45 $Mg/m^3$ or more is obtained. The density of the sintered body can be 7.50 $Mg/m^3$ or more.

[Aging Treatment Process]

Aging treatment process is a process in which the sintered body is heat treated at lower temperature than the sintering temperature. Whether the aging treatment is performed is not particularly limited and the number of the aging treatment steps is also not particularly limited, and it is suitably performed according to the desired magnetic properties. In addition, when the latter mentioned grain boundary diffusion process is adopted, said process can also be the aging treatment process. The aging treatments of two steps are performed to the R-T-B based permanent magnet of the embodiment. Hereinafter, the embodiment in which aging treatments of two steps are performed is described.

The aging treatment process of the first time is defined "the first aging process" and the aging treatment process of the second time is defined "the second aging process". An aging temperature of the first aging process is defined as T1 and an aging temperature of the second aging process is defined as T2.

Temperature T1 and the aging time during the first aging process are not particularly limited, and may be 700° C. or more and 900° C. or less and one hour to 10 hours.

Temperature T2 and the aging time during the second aging process are not particularly limited, and may be 450° C. or more and 700° C. or less and one hour to 10 hours.

By such aging treatments, the magnetic properties, especially the coercive force HcJ of the finally obtained R-T-B based permanent magnet can be improved.

The production stability of R-T-B based permanent magnet of the present embodiment can be confirmed by the difference of the magnetic properties due to the change of the aging temperature. For instance, in case when the difference of the magnetic properties due to the change of the aging temperature is large, the magnetic properties change by small change of the aging temperature. Therefore, an acceptable range of the aging temperature during the aging process becomes narrow and the production stability becomes low. On the contrary, in case when the difference of the magnetic properties due to the change of the aging temperature is small, the magnetic properties become difficult to change even the aging temperature changes. Therefore, the acceptable range of the aging temperature during the aging process becomes wide and the production stability becomes high.

Thus obtained R-T-B based permanent magnet of the present embodiment has desired characteristics. In concrete, the residual magnetic flux density and the coercive force HcJ are high and the corrosion resistance and the production stability are superior. In addition, in case when the latter mentioned grain boundary diffusion process is performed, decreasing rate of the residual magnetic flux density when the heavy rare earth element is diffused along the grain boundaries is small and increasing rate of the coercive force HcJ is large. Namely, the R-T-B based permanent magnet of the present embodiment is a magnet suitable for the grain boundary diffusion.

Note, the R-T-B based permanent magnet of the present embodiment obtained by the above method becomes an R-T-B based permanent magnet product by magnetizing.

The R-T-B based permanent magnet according to the present embodiment is suitably used for a motor, an electric generator, and etc.

Note, the invention is not limited to the above described embodiment and can be varied within the scope of the invention.

The R-T-B based permanent magnet can be obtained by the method above; however, the manufacturing method of said R-T-B based permanent magnet is not limited thereto and may be suitably changed. For instance, the R-T-B based permanent magnet of the embodiment may be manufactured by hot deformation method. The manufacturing method of the R-T-B based permanent magnet by hot deformation method includes the following processes.

(a) A rapid quenching process, in which the raw material metal is melted and the obtained molten metal is rapidly cooled to obtain a thin ribbon.

(b) A pulverization process, in which the thin ribbon is pulverized and flake-like raw material powder is obtained.

(c) A cold compacting process, in which the pulverized raw material powder is cold compacted.

(d) A preheating process, in which the cold compacted body is preheated.

(e) A hot compacting process, in which the preheated cold compacted body is hot compacted.

(f) A hot plastic deforming process, in which the hot compacted body is plastically deformed to a predetermined shape.

(g) An aging treatment process, in which the R-T-B based permanent magnet is made aging treatment.

Hereinafter, a method in which the heavy rare earth element is diffused along the grain boundaries in the R-T-B based permanent magnet of the present embodiment is described.

[Machining Process (Before the Grain Boundary Diffusion)]

A process for machining the R-T-B based permanent magnet according to the present embodiment to show a desired shape may be employed when necessary. The machining process exemplifies a shape machining such as cutting and grinding, chamfering such as barrel polishing, and etc.

[Grain Boundary Diffusion Process]

Grain boundary diffusion is performed by heat treating after adhering heavy rare earth metal, compound, alloy, and etc., each including heavy rare earth element on the surface of the R-T-B based permanent magnet by application, coating, deposition, and etc. Coercive force HcJ of the finally obtained R-T-B based permanent magnet can be further enhanced by the grain boundary diffusion of the heavy rare earth element.

The heavy rare earth element may be Dy or Tb, and Tb is preferable.

In the embodiments hereinafter, an applying material such as slurry, paste, and etc., including the heavy rare earth element is prepared, and the applying material is applied on the surface of the R-T-B based permanent magnet.

State of the applying material is optional, e.g. powdery state, slurry state, etc. What is used as the heavy rare earth metal, the compound or the alloy each including the heavy rare earth element is optional, and what is used as a solvent or a dispersion medium is also optional. In addition, the concentration of heavy rare earth element in the applying material is also optional.

A diffusing treatment temperature during the grain boundary diffusion process according to the present embodiment can be 800 to 950° C. The diffusion treatment time can be one hour to 50 hours. Note, the grain boundary diffusion process can also be the above-mentioned aging treatment process.

An additional heat treatment may be performed after the diffusion treatment. In this case, heat treatment temperature may be 450 to 600° C. The heat treatment time may be one hour to 10 hours. The magnetic properties, especially coercive force HcJ, of the finally obtained R-T-B based permanent magnet can be further enhanced by such heat treatment.

The production stability of R-T-B based permanent magnet of the present embodiment can be confirmed by the difference of the magnetic properties due to the change of the diffusion treatment temperature during the grain boundary diffusion process and/or the heat treatment temperature after diffusing heavy rare earth element. Hereinafter, the diffusion treatment temperature during the heavy rare earth element diffusion process is described; however, it is the same with the heat treatment temperature after diffusing the heavy rare earth element. For instance, in case when the difference of the magnetic properties due to the change of the diffusion treatment temperature is large, the magnetic properties change by small change of the diffusion treatment temperature. Therefore, an acceptable range of the diffusion treatment temperature during the grain boundary diffusion process becomes narrow and the production stability becomes low. On the contrary, in case when the difference of the magnetic properties due to the change of the diffusion treatment temperature is small, the magnetic properties become difficult to change even the diffusion treatment temperature changes. Therefore, the acceptable range of the diffusion treatment temperature during the grain boundary diffusion process becomes wide and the production stability becomes high.

[Machining Process (after the Grain Boundary Diffusion)]

Various kinds of the machining may be performed on the R-T-B based permanent magnet after the grain boundary diffusion process. A kind of the machining is not particularly limited. For instance, a shape machining such as cutting and grinding, a surface machining such as chamfering including barrel polishing, and etc. can be performed.

EXAMPLE

Hereinafter, the invention will be described in detail referring to examples; however, the invention is not limited thereto.

Example 1

(Manufacturing R-T-B Based Sintered Magnet)

Nd, Pr, an electrolytic iron and a low carbon ferroboron alloy were prepared as the raw material metal. Further, Al, Ga, Cu, Co, Mn and Zr were prepared as a pure metal or an alloy with Fe.

The raw material alloy was prepared by strip casting method using the above-mentioned raw material metals to make the finally obtained magnet composition to show the composition of each sample shown in below-mentioned Tables 1 and 3. Content (ppm) of "C", "N" and "O" shown in Tables 1 and 3 each show the content with respect to a total mass of the magnet. Fe is not shown in Table 3, however, content (mass %) of each element other than "C", "N" and "O" shown in Tables 1 and 3 are values when the total content of Nd, Pr, B, Al, Ga, Cu, Co, Mn, Zr and Fe are 100 mass %. The thickness of said raw material alloy was 0.2 to 0.4 mm.

Subsequently, hydrogen was absorbed by flowing hydrogen gas into said raw material alloy at room temperature for one hour. Then, the atmosphere was changed to Ar gas and dehydrogenation treatment was performed at 600° C. for one hour, and hydrogen storage pulverization was performed to said raw material alloy. Considering sample numbers 74 to 76, nitrogen gas concentration in the atmosphere during the dehydrogenation treatment was regulated to make nitrogen content to be a predetermined amount. Subsequently, after cooling, said dehydrogenation treated raw material alloy were sieved to be powder having particle diameter of 425 Lm or less. Note, from the hydrogen storage pulverization process to the latter mentioned sintering process, the atmosphere was low oxygen atmosphere in which oxygen concentration is always less than 200 ppm. Considering sample numbers 67 to 71, the oxygen concentration in the atmosphere was regulated making oxygen content to be a predetermined amount.

Subsequently, a mass ratio of 0.1% oleyamide was added as the pulverization aid with respect to the raw material alloy powder after the hydrogen storage pulverization and sieving, and then mixed thereof. Considering sample numbers 63 to 66, amount of the pulverization aid added was regulated in order to make the carbon content to be a predetermined amount.

Subsequently, the obtained powder was finely pulverized in a nitrogen gas stream using an impact plate type jet mill apparatus, and fine powder (raw material powder) having average particle diameter of 3.9 to 4.2 μm was obtained. Considering samples 72 and 73, the obtained powder was finely pulverized in a mixed gas stream of Ar and nitrogen, and the nitrogen gas concentration was adjusted to make the nitrogen content to be a predetermined amount. Note, said average particle diameter is average particle diameter D50 measured by a laser diffraction type particle size analyzer.

The obtained fine powder was compacted in the magnetic field and a green compact was manufactured. The applied magnetic field when compacting was a static magnetic field of 1,200 kA/m. The compaction pressure was 98 MPa. A magnetic field applied direction and a compressing direction were at a right angle. Density of the green compact at this point was measured. Densities of all the compacted bodies were within 4.10 $Mg/m^3$ to 4.25 $Mg/m^3$.

Subsequently, the green compact was sintered and a sintered body was obtained. Optimum conditions of the sintering vary according to such as the composition; however, they were set within 1,040° C. to 1,100° C. and held for four hours. Sintering atmosphere was a vacuum. The sintered density at this point was within 7.45 $Mg/m^3$ to 7.55 $Mg/m^3$. Then, in Ar atmosphere under an atmospheric pressure, the first aging treatment was performed at the first aging temperature T1=850° C. for one hour, and the second aging treatment was further performed at the second aging temperature T2=520° C. for one hour. Accordingly, the R-T-B based sintered magnet of each sample shown in Tables 1 and 3 were obtained.

The composition of the obtained R-T-B based sintered magnet was evaluated by the X-ray fluorescence analysis. "B" as boron was evaluated by the ICP analysis. Oxygen content was measured by the inert gas fusion-nondispersive infrared absorption method. Carbon content was measured by the combustion in oxygen stream-infrared absorption method. Nitrogen content was measured by the inert gas fusion-thermal conductivity method. It was confirmed that the compositions of each sample are as shown in Tables 1 and 3.

Subsequently, said R-T-B based sintered magnet was ground to 14 mm×10 mm×11 mm (the direction of easy magnetization axis was 11 mm) by a vertical grinding machine, and the magnetic properties were evaluated by BH tracer. Note, the magnet was magnetized before the measurement by a pulse magnetic field of 4,000 kA/m.

Generally, the residual magnetic flux density and the coercive force HcJ are in the relationship of a trade-off. Namely, the coercive force HcJ tends to be low as the residual magnetic flux density is high, and the residual magnetic flux density tends to be low as the coercive force HcJ is high. Accordingly, a performance index PI (Potential Index) was set in the present embodiment to comprehensively evaluate the residual magnetic flux density and the coercive force HcJ. The following equation was defined when the magnitude of the residual magnetic flux density measured by mT unit is Br (mT) and the same of coercive force HcJ measured by kA/m unit is HcJ (kA/m).

$$PI=Br+25\times HcJ\times 4\pi/2{,}000$$

According to the present example, in case of PI≥1,635 before the latter mentioned Tb diffusion, the residual magnetic flux density and the coercive force HcJ before Tb diffusion were regarded as good. In addition, it was regarded as good when the squareness ratio Hk/HcJ before Tb diffusion is 97% or more. Note, the squareness ratio Hk/HcJ in the present invention was calculated by Hk/HcJ×100(%) when Hk (kA/m) is the magnetic field when the magnetization J reaches 90% of Br in the second quadrant (J-H demagnetization curve) of a magnetization J-magnetic field H curve.

Samples showing PI before Tb diffusion of 1,635 or more and the squareness ratio before Tb diffusion of 97% or more were determined good, and shown by a symbol "○". Samples showing either characteristic to be not good were determined not good, and shown by a symbol "×".

In addition, corrosion resistance of each sample was tested. Corrosion resistance was tested by PCT test, Pressure Cooker Test, under a saturated moisture content air. In concrete, mass change of the R-T-B based sintered magnet before and after the test under pressure of 2 atm for 1,000 hours in 100% RH atmosphere was measured. The corrosion resistance was regarded as good in case when the mass decrease per a total surface area of the magnet was 3 $mg/cm^2$ or less. The corrosion resistance was regarded as particularly good when the mass decrease was 2 $mg/cm^2$ or less. Samples showed the corrosion resistance of particularly good, good and not good, which are shown by the symbols "◎", "○" and "×", respectively. Note, there was no not good sample among the corrosion resistance tested samples in the invention.

[Tb Diffusion]

In addition, the R-T-B based sintered magnet obtained in the above process was ground to 14 mm×10 mm×4.2 mm. The thickness in the direction of easy axis of magnetization was 4.2 mm. The sintered magnet was etched by carrying out a set of treatments of immersing in a mixed solution of nitric acid and ethanol including 3 mass % of nitric acid with respect to 100 mass % of ethanol for three minutes, and then immersing in ethanol for one minute. Said set of treatments was repeated twice. Subsequently, slurry, in which $TbH_2$ particles (average particle diameter D50=10.0 μm) were dispersed in ethanol, was applied on the whole area of the sintered magnet after the etching treatment making a mass ratio of Tb with respect to mass of the sintered magnet to be 0.6 mass %.

After applying and drying the slurry, the diffusion treatment was performed in flowing Ar atmosphere (1 atm) at 930° C. for 18 hours, and then the heat treatment was performed at 520° C. for four hours.

The surface of the sintered magnet after the heat treatment was ground by 0.1 mm per each face, and then the magnetic properties thereof were evaluated by BH tracer. The magnetic properties were evaluated after magnetizing by 4,000 kA/m pulse magnetic field. A thickness of the sintered magnet was thin. Thus, three sintered magnets were layered one on top of the other, and evaluated thereof. In the present embodiment, the difference of residual magnetic flux density Br due to Tb diffusion is defined ΔBr and the difference of coercive force due to Tb diffusion is defined ΔHcJ. Namely, ΔBr=(Br after Tb diffusion)−(Br before Tb diffusion) and ΔHcJ=(HcJ after Tb diffusion)−(HcJ before Tb diffusion). Note, samples showing PI after Tb diffusion of 1,745 or more were determined "good" and 1,765 or more were determined particularly good. The squareness ratio after Tb diffusion of 90% or more was determined "good".

Samples showing PI after Tb diffusion of 1,745 or more and the squareness ratio after Tb diffusion of 90% or more were determined good and shown by the symbol "○". Samples showing either characteristic to be not good were determined not good and shown by the symbol "×".

TABLE 1

| | R-T-B based sintered magnet composition(before Tb diffusion) | | | | | | | | | | | | | | | |
|---|---|---|---|---|---|---|---|---|---|---|---|---|---|---|---|---|
| Sample No. | Nd (mass %) | Pr (mass %) | TRE (mass %) | B (mass %) | TRE/B atomic ratio | Al (mass %) | Ga (mass %) | Cu (mass %) | Co (mass %) | Mn (mass %) | Zr (mass %) | Fe (mass %) | C (ppm) | N (ppm) | O (ppm) | 14B/(Fe + Co) (atomic ratio) |
| 1* | 23.0 | 7.7 | 30.7 | 0.96 | 2.41 | 0.20 | 0.20 | 0.20 | 2.0 | 0.03 | 0.15 | 65.56 | 900 | 500 | 500 | 1.03 |
| 2* | 23.0 | 7.7 | 30.7 | 0.95 | 2.44 | 0.20 | 0.20 | 0.20 | 2.0 | 0.03 | 0.15 | 65.57 | 900 | 500 | 500 | 1.02 |
| 3* | 23.0 | 7.7 | 30.7 | 0.94 | 2.46 | 0.20 | 0.20 | 0.20 | 2.0 | 0.03 | 0.15 | 65.58 | 900 | 500 | 500 | 1.01 |
| 4* | 23.0 | 7.7 | 30.7 | 0.93 | 2.49 | 0.20 | 0.20 | 0.20 | 2.0 | 0.03 | 0.15 | 65.59 | 900 | 500 | 500 | 1.00 |
| 5* | 23.0 | 7.7 | 30.7 | 0.90 | 2.57 | 0.20 | 0.20 | 0.20 | 2.0 | 0.03 | 0.15 | 65.62 | 900 | 500 | 500 | 0.96 |
| 6* | 23.0 | 7.7 | 30.7 | 0.88 | 2.63 | 0.20 | 0.20 | 0.20 | 2.0 | 0.03 | 0.15 | 65.64 | 900 | 500 | 500 | 0.94 |
| 7* | 23.0 | 7.7 | 30.7 | 0.85 | 2.72 | 0.20 | 0.20 | 0.20 | 2.0 | 0.03 | 0.15 | 65.67 | 900 | 500 | 500 | 0.91 |
| 8* | 22.6 | 7.6 | 30.2 | 0.96 | 2.37 | 0.20 | 0.20 | 0.20 | 2.0 | 0.03 | 0.15 | 66.06 | 900 | 500 | 500 | 1.02 |
| 9 | 22.6 | 7.6 | 30.2 | 0.95 | 2.40 | 0.20 | 0.20 | 0.20 | 2.0 | 0.03 | 0.15 | 66.07 | 900 | 500 | 500 | 1.01 |
| 10 | 22.6 | 7.6 | 30.2 | 0.94 | 2.42 | 0.20 | 0.20 | 0.20 | 2.0 | 0.03 | 0.15 | 66.08 | 900 | 500 | 500 | 1.00 |
| 11 | 22.6 | 7.6 | 30.2 | 0.93 | 2.45 | 0.20 | 0.20 | 0.20 | 2.0 | 0.03 | 0.15 | 66.09 | 900 | 500 | 500 | 0.99 |
| 12 | 22.6 | 7.6 | 30.2 | 0.90 | 2.53 | 0.20 | 0.20 | 0.20 | 2.0 | 0.03 | 0.15 | 66.12 | 900 | 500 | 500 | 0.96 |
| 13 | 22.6 | 7.6 | 30.2 | 0.88 | 2.59 | 0.20 | 0.20 | 0.20 | 2.0 | 0.03 | 0.15 | 66.14 | 900 | 500 | 500 | 0.94 |
| 14* | 22.3 | 7.4 | 29.7 | 0.96 | 2.33 | 0.20 | 0.20 | 0.20 | 2.0 | 0.03 | 0.15 | 66.56 | 900 | 500 | 500 | 1.01 |
| 15 | 22.3 | 7.4 | 29.7 | 0.95 | 2.36 | 0.20 | 0.20 | 0.20 | 2.0 | 0.03 | 0.15 | 66.57 | 900 | 500 | 500 | 1.00 |
| 16 | 22.3 | 7.4 | 29.7 | 0.94 | 2.38 | 0.20 | 0.20 | 0.20 | 2.0 | 0.03 | 0.15 | 66.58 | 900 | 500 | 500 | 0.99 |
| 17 | 22.3 | 7.4 | 29.7 | 0.93 | 2.41 | 0.20 | 0.20 | 0.20 | 2.0 | 0.03 | 0.15 | 66.59 | 900 | 500 | 500 | 0.98 |
| 18 | 22.3 | 7.4 | 29.7 | 0.90 | 2.49 | 0.20 | 0.20 | 0.20 | 2.0 | 0.03 | 0.15 | 66.62 | 900 | 500 | 500 | 0.95 |
| 19 | 22.3 | 7.4 | 29.7 | 0.88 | 2.54 | 0.20 | 0.20 | 0.20 | 2.0 | 0.03 | 0.15 | 66.64 | 900 | 500 | 500 | 0.93 |
| 20 | 22.3 | 7.4 | 29.7 | 0.85 | 2.63 | 0.20 | 0.20 | 0.20 | 2.0 | 0.03 | 0.15 | 66.67 | 900 | 500 | 500 | 0.90 |
| 21* | 21.9 | 7.3 | 29.2 | 0.96 | 2.29 | 0.20 | 0.20 | 0.20 | 2.0 | 0.03 | 0.15 | 67.06 | 900 | 500 | 500 | 1.01 |
| 22 | 21.9 | 7.3 | 29.2 | 0.95 | 2.32 | 0.20 | 0.20 | 0.20 | 2.0 | 0.03 | 0.15 | 67.07 | 900 | 500 | 500 | 1.00 |
| 23 | 21.9 | 7.3 | 29.2 | 0.94 | 2.34 | 0.20 | 0.20 | 0.20 | 2.0 | 0.03 | 0.15 | 67.08 | 900 | 500 | 500 | 0.99 |
| 24 | 21.9 | 7.3 | 29.2 | 0.93 | 2.37 | 0.20 | 0.20 | 0.20 | 2.0 | 0.03 | 0.15 | 67.09 | 900 | 500 | 500 | 0.98 |
| 25 | 21.9 | 7.3 | 29.2 | 0.90 | 2.45 | 0.20 | 0.20 | 0.20 | 2.0 | 0.03 | 0.15 | 67.12 | 900 | 500 | 500 | 0.94 |
| 26 | 21.9 | 7.3 | 29.2 | 0.88 | 2.50 | 0.20 | 0.20 | 0.20 | 2.0 | 0.03 | 0.15 | 67.14 | 900 | 500 | 500 | 0.92 |
| 27 | 21.9 | 7.3 | 29.2 | 0.85 | 2.59 | 0.20 | 0.20 | 0.20 | 2.0 | 0.03 | 0.15 | 67.17 | 900 | 500 | 500 | 0.89 |
| 28* | 21.7 | 7.2 | 28.9 | 0.96 | 2.27 | 0.20 | 0.20 | 0.20 | 2.0 | 0.03 | 0.15 | 67.36 | 900 | 500 | 500 | 1.00 |
| 29 | 21.7 | 7.2 | 28.9 | 0.95 | 2.29 | 0.20 | 0.20 | 0.20 | 2.0 | 0.03 | 0.15 | 67.37 | 900 | 500 | 500 | 0.99 |
| 30 | 21.7 | 7.2 | 28.9 | 0.94 | 2.32 | 0.20 | 0.20 | 0.20 | 2.0 | 0.03 | 0.15 | 67.38 | 900 | 500 | 500 | 0.98 |
| 31 | 21.7 | 7.2 | 28.9 | 0.93 | 2.34 | 0.20 | 0.20 | 0.20 | 2.0 | 0.03 | 0.15 | 67.39 | 900 | 500 | 500 | 0.97 |
| 32 | 21.7 | 7.2 | 28.9 | 0.90 | 2.42 | 0.20 | 0.20 | 0.20 | 2.0 | 0.03 | 0.15 | 67.42 | 900 | 500 | 500 | 0.94 |
| 33 | 21.7 | 7.2 | 28.9 | 0.88 | 2.48 | 0.20 | 0.20 | 0.20 | 2.0 | 0.03 | 0.15 | 67.44 | 900 | 500 | 500 | 0.92 |
| 34 | 21.7 | 7.2 | 28.9 | 0.85 | 2.56 | 0.20 | 0.20 | 0.20 | 2.0 | 0.03 | 0.15 | 67.47 | 900 | 500 | 500 | 0.89 |
| 35* | 21.0 | 7.0 | 28.0 | 0.96 | 2.20 | 0.20 | 0.20 | 0.20 | 2.0 | 0.03 | 0.15 | 68.26 | 900 | 500 | 500 | 0.99 |
| 36 | 21.0 | 7.0 | 28.0 | 0.95 | 2.22 | 0.20 | 0.20 | 0.20 | 2.0 | 0.03 | 0.15 | 68.27 | 900 | 500 | 500 | 0.98 |
| 37 | 21.0 | 7.0 | 28.0 | 0.94 | 2.25 | 0.20 | 0.20 | 0.20 | 2.0 | 0.03 | 0.15 | 68.28 | 900 | 500 | 500 | 0.97 |
| 38 | 21.0 | 7.0 | 28.0 | 0.93 | 2.27 | 0.20 | 0.20 | 0.20 | 2.0 | 0.03 | 0.15 | 68.29 | 900 | 500 | 500 | 0.96 |
| 39 | 21.0 | 7.0 | 28.0 | 0.90 | 2.35 | 0.20 | 0.20 | 0.20 | 2.0 | 0.03 | 0.15 | 68.32 | 900 | 500 | 500 | 0.93 |
| 40 | 21.0 | 7.0 | 28.0 | 0.88 | 2.40 | 0.20 | 0.20 | 0.20 | 2.0 | 0.03 | 0.15 | 68.34 | 900 | 500 | 500 | 0.91 |

*is Comp. Ex.

TABLE 2

| | Before Tb diffusion | | | | | | Difference due to Tb diffusion | | After Tb diffusion | | | | |
|---|---|---|---|---|---|---|---|---|---|---|---|---|---|
| Sample No. | Br (mT) | HcJ (kA/m) | PI | Hk/HcJ (%) | Br, HcJ, Hk/HcJ Evaluation | Corrosion Resistance Evaluation | ΔBr (mT) | ΔHcJ (kA/m) | Br (mT) | HcJ (kA/m) | PI | Hk/HcJ (%) | Br, HcJ, Hk/HcJ Evaluation |
| 1* | 1441 | 1220 | 1633 | 98.9 | X | ◎ | −9 | 699 | 1432 | 1919 | 1733 | 92.1 | X |
| 2* | 1440 | 1230 | 1633 | 98.8 | X | ◎ | −5 | 701 | 1435 | 1931 | 1738 | 97.8 | X |
| 3* | 1441 | 1245 | 1637 | 98.8 | ○ | ◎ | −7 | 708 | 1434 | 1953 | 1741 | 97.8 | X |
| 4* | 1439 | 1260 | 1637 | 98.9 | ○ | ◎ | −6 | 705 | 1433 | 1965 | 1742 | 97.8 | X |
| 5* | 1438 | 1278 | 1639 | 98.7 | ○ | ◎ | −6 | 695 | 1432 | 1973 | 1742 | 97.3 | X |
| 6* | 1435 | 1291 | 1638 | 98.5 | ○ | ◎ | −6 | 683 | 1429 | 1974 | 1739 | 97.8 | X |
| 7* | 1424 | 1249 | 1620 | 98.4 | X | ◎ | −8 | 678 | 1416 | 1927 | 1719 | 97.2 | X |
| 8* | 1453 | 1194 | 1641 | 98.7 | ○ | ◎ | −8 | 723 | 1445 | 1917 | 1746 | 86.5 | X |
| 9 | 1454 | 1199 | 1642 | 98.7 | ○ | ◎ | −6 | 735 | 1448 | 1934 | 1752 | 98.0 | ○ |
| 10 | 1453 | 1214 | 1644 | 98.8 | ○ | ◎ | −6 | 738 | 1447 | 1952 | 1754 | 98.5 | ○ |
| 11 | 1454 | 1235 | 1648 | 98.8 | ○ | ◎ | −9 | 726 | 1445 | 1961 | 1753 | 98.7 | ○ |

TABLE 2-continued

| | Before Tb diffusion | | | | | | Difference due to Tb diffusion | | After Tb diffusion | | | | |
|---|---|---|---|---|---|---|---|---|---|---|---|---|---|
| Sample No. | Br (mT) | HcJ (kA/m) | PI | Hk/HcJ (%) | Br, HcJ, Hk/HcJ Evaluation | Corrosion Resistance Evaluation | ΔBr (mT) | ΔHcJ (kA/m) | Br (mT) | HcJ (kA/m) | PI | Hk/HcJ (%) | Br, HcJ, Hk/HcJ Evaluation |
| 12 | 1450 | 1254 | 1647 | 98.5 | ○ | ◎ | −10 | 719 | 1440 | 1973 | 1750 | 98.3 | ○ |
| 13 | 1448 | 1262 | 1646 | 98.5 | ○ | ◎ | −8 | 708 | 1440 | 1970 | 1749 | 98.3 | ○ |
| 14* | 1470 | 1151 | 1651 | 99.5 | ○ | ◎ | −6 | 762 | 1464 | 1913 | 1764 | 85.9 | X |
| 15 | 1470 | 1162 | 1653 | 99.5 | ○ | ◎ | −5 | 766 | 1465 | 1928 | 1768 | 98.1 | ○ |
| 16 | 1471 | 1184 | 1657 | 99.6 | ○ | ◎ | −6 | 762 | 1465 | 1946 | 1771 | 98.1 | ○ |
| 17 | 1472 | 1197 | 1660 | 99.7 | ○ | ◎ | −8 | 761 | 1464 | 1958 | 1772 | 98.1 | ○ |
| 18 | 1466 | 1225 | 1658 | 99.4 | ○ | ◎ | −5 | 745 | 1461 | 1970 | 1770 | 98.0 | ○ |
| 19 | 1463 | 1240 | 1658 | 99.0 | ○ | ◎ | −5 | 724 | 1458 | 1964 | 1767 | 98.1 | ○ |
| 20 | 1452 | 1211 | 1642 | 98.9 | ○ | ◎ | −7 | 714 | 1445 | 1925 | 1747 | 98.0 | ○ |
| 21* | 1480 | 1101 | 1653 | 99.2 | ○ | ◎ | −4 | 770 | 1476 | 1871 | 1770 | 83.2 | X |
| 22 | 1478 | 1113 | 1653 | 98.9 | ○ | ◎ | −4 | 780 | 1474 | 1893 | 1771 | 97.8 | ○ |
| 23 | 1478 | 1136 | 1656 | 99.0 | ○ | ◎ | −3 | 781 | 1475 | 1917 | 1776 | 98.8 | ○ |
| 24 | 1477 | 1154 | 1658 | 99.1 | ○ | ◎ | −5 | 778 | 1472 | 1932 | 1775 | 99.1 | ○ |
| 25 | 1475 | 1192 | 1662 | 98.8 | ○ | ◎ | −6 | 760 | 1469 | 1952 | 1776 | 99.0 | ○ |
| 26 | 1473 | 1210 | 1663 | 98.9 | ○ | ◎ | −6 | 743 | 1467 | 1953 | 1774 | 98.9 | ○ |
| 27 | 1461 | 1162 | 1644 | 98.5 | ○ | ◎ | −5 | 732 | 1456 | 1894 | 1754 | 97.8 | ○ |
| 28* | 1488 | 1071 | 1656 | 99.2 | ○ | ◎ | −12 | 780 | 1476 | 1851 | 1767 | 89.4 | X |
| 29 | 1489 | 1084 | 1659 | 98.3 | ○ | ◎ | −8 | 789 | 1481 | 1873 | 1775 | 97.7 | ○ |
| 30 | 1488 | 1100 | 1661 | 98.4 | ○ | ◎ | −9 | 791 | 1479 | 1891 | 1776 | 97.2 | ○ |
| 31 | 1487 | 1123 | 1663 | 98.3 | ○ | ◎ | −6 | 790 | 1481 | 1913 | 1781 | 97.3 | ○ |
| 32 | 1490 | 1165 | 1673 | 98.9 | ○ | ◎ | −14 | 767 | 1476 | 1932 | 1779 | 95.7 | ○ |
| 33 | 1486 | 1183 | 1672 | 98.0 | ○ | ◎ | −12 | 750 | 1474 | 1933 | 1778 | 96.0 | ○ |
| 34 | 1472 | 1135 | 1650 | 97.7 | ○ | ◎ | −11 | 737 | 1461 | 1872 | 1755 | 95.5 | ○ |
| 35* | 1481 | 996 | 1637 | 99.0 | ○ | ◎ | −10 | 780 | 1471 | 1776 | 1750 | 89.1 | X |
| 36 | 1480 | 1010 | 1639 | 99.1 | ○ | ◎ | −4 | 792 | 1476 | 1802 | 1759 | 99.0 | ○ |
| 37 | 1479 | 1031 | 1641 | 98.9 | ○ | ◎ | −9 | 793 | 1470 | 1824 | 1757 | 98.4 | ○ |
| 38 | 1480 | 1056 | 1646 | 98.7 | ○ | ◎ | −12 | 790 | 1468 | 1846 | 1758 | 98.5 | ○ |
| 39 | 1477 | 1077 | 1646 | 98.8 | ○ | ◎ | −9 | 774 | 1468 | 1851 | 1759 | 98.2 | ○ |
| 40 | 1474 | 1085 | 1644 | 98.5 | ○ | ◎ | −8 | 755 | 1466 | 1840 | 1755 | 98.0 | ○ |

*is Comp. Ex.
◎ is a particularly good characteristic
○ is a good characteristic
X is a not good characteristic
* ΔBr: the difference of residual magnetic flux density Br between before and after Tb diffusion
ΔBr = (Br after Tb diffusion) − (Br before Tb diffusion)
ΔHcJ: the difference of coercive force HcJ between before and after Tb diffusion
ΔHcJ = (HcJ after Tb diffusion) − (HcJ before Tb diffusion)

TABLE 3

| | R-T-B based sintered magnet composition (before Tb diffusion) | | | | | | | | | | | | |
|---|---|---|---|---|---|---|---|---|---|---|---|---|---|
| Sample No. | Nd (mass %) | Pr (mass %) | TRE (mass %) | B (mass %) | Al (mass %) | Ga (mass %) | Cu (mass %) | Co (mass %) | Mn (mass %) | Zr (mass %) | C (ppm) | N (ppm) | O (ppm) |
| 41 | 22.3 | 7.4 | 29.7 | 0.93 | 0.20 | 0.20 | 0.20 | 0.5 | 0.03 | 0.15 | 900 | 500 | 500 |
| 42 | 22.3 | 7.4 | 29.7 | 0.93 | 0.20 | 0.20 | 0.20 | 1.0 | 0.03 | 0.15 | 900 | 500 | 500 |
| 17 | 22.3 | 7.4 | 29.7 | 0.93 | 0.20 | 0.20 | 0.20 | 2.0 | 0.03 | 0.15 | 900 | 500 | 500 |
| 44 | 22.3 | 7.4 | 29.7 | 0.93 | 0.20 | 0.20 | 0.20 | 3.0 | 0.03 | 0.15 | 900 | 500 | 500 |
| 45 | 22.3 | 7.4 | 29.7 | 0.93 | 0.15 | 0.20 | 0.20 | 2.0 | 0.03 | 0.15 | 900 | 500 | 500 |
| 17 | 22.3 | 7.4 | 29.7 | 0.93 | 0.20 | 0.20 | 0.20 | 2.0 | 0.03 | 0.15 | 900 | 500 | 500 |
| 47 | 22.3 | 7.4 | 29.7 | 0.93 | 0.25 | 0.20 | 0.20 | 2.0 | 0.03 | 0.15 | 900 | 500 | 500 |
| 48 | 22.3 | 7.4 | 29.7 | 0.93 | 0.30 | 0.20 | 0.20 | 2.0 | 0.03 | 0.15 | 900 | 500 | 500 |
| 49 | 22.3 | 7.4 | 29.7 | 0.93 | 0.20 | 0.20 | 0.04 | 2.0 | 0.03 | 0.15 | 900 | 500 | 500 |
| 50 | 22.3 | 7.4 | 29.7 | 0.93 | 0.20 | 0.20 | 0.10 | 2.0 | 0.03 | 0.15 | 900 | 500 | 500 |
| 17 | 22.3 | 7.4 | 29.7 | 0.93 | 0.20 | 0.20 | 0.20 | 2.0 | 0.03 | 0.15 | 900 | 500 | 500 |
| 52 | 22.3 | 7.4 | 29.7 | 0.93 | 0.20 | 0.20 | 0.30 | 2.0 | 0.03 | 0.15 | 900 | 500 | 500 |
| 53 | 22.3 | 7.4 | 29.7 | 0.93 | 0.20 | 0.20 | 0.50 | 2.0 | 0.03 | 0.15 | 900 | 500 | 500 |
| 54 | 22.3 | 7.4 | 29.7 | 0.93 | 0.20 | 0.08 | 0.20 | 2.0 | 0.03 | 0.15 | 900 | 500 | 500 |
| 55 | 22.3 | 7.4 | 29.7 | 0.93 | 0.20 | 0.10 | 0.20 | 2.0 | 0.03 | 0.15 | 900 | 500 | 500 |
| 17 | 22.3 | 7.4 | 29.7 | 0.93 | 0.20 | 0.20 | 0.20 | 2.0 | 0.03 | 0.15 | 900 | 500 | 500 |
| 57 | 22.3 | 7.4 | 29.7 | 0.93 | 0.20 | 0.25 | 0.20 | 2.0 | 0.03 | 0.15 | 900 | 500 | 500 |
| 58 | 22.3 | 7.4 | 29.7 | 0.93 | 0.20 | 0.30 | 0.20 | 2.0 | 0.03 | 0.15 | 900 | 500 | 500 |
| 59 | 22.3 | 7.4 | 29.7 | 0.93 | 0.20 | 0.20 | 0.20 | 2.0 | 0.03 | 0.10 | 900 | 500 | 500 |
| 17 | 22.3 | 7.4 | 29.7 | 0.93 | 0.20 | 0.20 | 0.20 | 2.0 | 0.03 | 0.15 | 900 | 500 | 500 |
| 61 | 22.3 | 7.4 | 29.7 | 0.93 | 0.20 | 0.20 | 0.20 | 2.0 | 0.03 | 0.25 | 900 | 500 | 500 |
| 62 | 22.3 | 7.4 | 29.7 | 0.93 | 0.20 | 0.20 | 0.20 | 2.0 | 0.03 | 0.30 | 900 | 500 | 500 |
| 63 | 22.3 | 7.4 | 29.7 | 0.93 | 0.20 | 0.20 | 0.20 | 2.0 | 0.03 | 0.15 | 600 | 500 | 500 |

TABLE 3-continued

| Sample No. | R-T-B based sintered magnet composition (before Tb diffusion) | | | | | | | | | | | | |
|---|---|---|---|---|---|---|---|---|---|---|---|---|---|
| | Nd (mass %) | Pr (mass %) | TRE (mass %) | B (mass %) | Al (mass %) | Ga (mass %) | Cu (mass %) | Co (mass %) | Mn (mass %) | Zr (mass %) | C (ppm) | N (ppm) | O (ppm) |
| 64 | 22.3 | 7.4 | 29.7 | 0.93 | 0.20 | 0.20 | 0.20 | 2.0 | 0.03 | 0.15 | 750 | 500 | 500 |
| 17 | 22.3 | 7.4 | 29.7 | 0.93 | 0.20 | 0.20 | 0.20 | 2.0 | 0.03 | 0.15 | 900 | 500 | 500 |
| 65 | 22.3 | 7.4 | 29.7 | 0.93 | 0.20 | 0.20 | 0.20 | 2.0 | 0.03 | 0.15 | 1000 | 500 | 500 |
| 66 | 22.3 | 7.4 | 29.7 | 0.93 | 0.20 | 0.20 | 0.20 | 2.0 | 0.03 | 0.15 | 1100 | 500 | 500 |
| 67 | 22.3 | 7.4 | 29.7 | 0.93 | 0.20 | 0.20 | 0.20 | 2.0 | 0.03 | 0.15 | 900 | 500 | 350 |
| 68 | 22.3 | 7.4 | 29.7 | 0.93 | 0.20 | 0.20 | 0.20 | 2.0 | 0.03 | 0.15 | 900 | 500 | 400 |
| 17 | 22.3 | 7.4 | 29.7 | 0.93 | 0.20 | 0.20 | 0.20 | 2.0 | 0.03 | 0.15 | 900 | 500 | 500 |
| 70 | 22.3 | 7.4 | 29.7 | 0.93 | 0.20 | 0.20 | 0.20 | 2.0 | 0.03 | 0.15 | 900 | 500 | 800 |
| 71 | 22.3 | 7.4 | 29.7 | 0.93 | 0.20 | 0.20 | 0.20 | 2.0 | 0.03 | 0.15 | 900 | 500 | 1000 |
| 72 | 22.3 | 7.4 | 29.7 | 0.93 | 0.20 | 0.20 | 0.20 | 2.0 | 0.03 | 0.15 | 900 | 250 | 500 |
| 73 | 22.3 | 7.4 | 29.7 | 0.93 | 0.20 | 0.20 | 0.20 | 2.0 | 0.03 | 0.15 | 900 | 300 | 500 |
| 17 | 22.3 | 7.4 | 29.7 | 0.93 | 0.20 | 0.20 | 0.20 | 2.0 | 0.03 | 0.15 | 900 | 500 | 500 |
| 74 | 22.3 | 7.4 | 29.7 | 0.93 | 0.20 | 0.20 | 0.20 | 2.0 | 0.03 | 0.15 | 900 | 600 | 500 |
| 75 | 22.3 | 7.4 | 29.7 | 0.93 | 0.20 | 0.20 | 0.20 | 2.0 | 0.03 | 0.15 | 900 | 700 | 500 |
| 76 | 22.3 | 7.4 | 29.7 | 0.93 | 0.20 | 0.20 | 0.20 | 2.0 | 0.03 | 0.15 | 900 | 1000 | 500 |
| 77 | 29.7 | 0.0 | 29.7 | 0.93 | 0.20 | 0.20 | 0.20 | 2.0 | 0.03 | 0.15 | 900 | 500 | 500 |
| 78 | 24.7 | 5.0 | 29.7 | 0.93 | 0.20 | 0.20 | 0.20 | 2.0 | 0.03 | 0.15 | 900 | 500 | 500 |
| 17 | 22.3 | 7.4 | 29.7 | 0.93 | 0.20 | 0.20 | 0.20 | 2.0 | 0.03 | 0.15 | 900 | 500 | 500 |
| 80 | 19.7 | 10.0 | 29.7 | 0.93 | 0.20 | 0.20 | 0.20 | 2.0 | 0.03 | 0.15 | 900 | 500 | 500 |

TABLE 4

| Sample No. | Before Tb diffusion | | | | | | Difference due to Tb diffusion | | After Tb diffusion | | | | |
|---|---|---|---|---|---|---|---|---|---|---|---|---|---|
| | Br (mT) | HcJ (kA/m) | PI | Hk/HcJ (%) | Br, HcJ, Hk/HcJ Evaluation | Corrosion Resistance Evaluation | ΔBr (mT) | ΔHcJ (kA/m) | Br (mT) | HcJ (kA/m) | PI | Hk/HcJ (%) | Br, HcJ, Hk/HcJ Evaluation |
| 41 | 1472 | 1162 | 1655 | 99.8 | ○ | ○ | −9 | 766 | 1463 | 1928 | 1766 | 98.1 | ○ |
| 42 | 1473 | 1172 | 1657 | 99.5 | ○ | ◎ | −8 | 765 | 1465 | 1937 | 1769 | 98.1 | ○ |
| 17 | 1472 | 1197 | 1660 | 99.7 | ○ | ◎ | −8 | 761 | 1464 | 1958 | 1772 | 98.1 | ○ |
| 44 | 1472 | 1155 | 1653 | 99.5 | ○ | ◎ | −8 | 762 | 1464 | 1917 | 1765 | 98.0 | ○ |
| 45 | 1478 | 1165 | 1661 | 99.6 | ○ | ◎ | −7 | 746 | 1471 | 1911 | 1771 | 97.9 | ○ |
| 17 | 1472 | 1197 | 1660 | 99.7 | ○ | ◎ | −8 | 761 | 1464 | 1958 | 1772 | 98.1 | ○ |
| 47 | 1465 | 1225 | 1657 | 99.5 | ○ | ◎ | −9 | 770 | 1456 | 1995 | 1769 | 98.1 | ○ |
| 48 | 1456 | 1249 | 1652 | 99.5 | ○ | ◎ | −11 | 780 | 1445 | 2029 | 1764 | 97.8 | ○ |
| 49 | 1475 | 1190 | 1662 | 99.7 | ○ | ○ | −9 | 741 | 1466 | 1931 | 1769 | 98.0 | ○ |
| 50 | 1473 | 1192 | 1660 | 99.5 | ○ | ◎ | −5 | 752 | 1468 | 1944 | 1773 | 97.7 | ○ |
| 17 | 1472 | 1197 | 1660 | 99.7 | ○ | ◎ | −8 | 761 | 1464 | 1958 | 1772 | 98.1 | ○ |
| 52 | 1468 | 1168 | 1651 | 99.5 | ○ | ◎ | −7 | 790 | 1461 | 1958 | 1769 | 98.2 | ○ |
| 53 | 1464 | 1112 | 1639 | 98.5 | ○ | ◎ | −8 | 811 | 1456 | 1923 | 1758 | 97.6 | ○ |
| 54 | 1476 | 1172 | 1660 | 99.2 | ○ | ◎ | −9 | 759 | 1467 | 1931 | 1770 | 98.3 | ○ |
| 55 | 1475 | 1177 | 1660 | 99.0 | ○ | ◎ | −9 | 759 | 1466 | 1936 | 1770 | 98.5 | ○ |
| 17 | 1472 | 1197 | 1660 | 99.7 | ○ | ◎ | −8 | 761 | 1464 | 1958 | 1772 | 98.1 | ○ |
| 57 | 1471 | 1200 | 1659 | 99.7 | ○ | ◎ | −9 | 764 | 1462 | 1964 | 1771 | 98.3 | ○ |
| 58 | 1469 | 1205 | 1658 | 99.7 | ○ | ◎ | −8 | 768 | 1461 | 1973 | 1771 | 98.1 | ○ |
| 59 | 1473 | 1185 | 1659 | 99.5 | ○ | ◎ | −8 | 766 | 1465 | 1951 | 1771 | 98.0 | ○ |
| 17 | 1472 | 1197 | 1660 | 99.7 | ○ | ◎ | −8 | 761 | 1464 | 1958 | 1772 | 98.1 | ○ |
| 61 | 1470 | 1208 | 1660 | 99.4 | ○ | ◎ | −11 | 759 | 1459 | 1967 | 1768 | 97.2 | ○ |
| 62 | 1466 | 1217 | 1657 | 99.2 | ○ | ◎ | −14 | 741 | 1452 | 1958 | 1760 | 97.2 | ○ |
| 63 | 1465 | 1242 | 1660 | 96.0 | ○ | ◎ | −3 | 762 | 1462 | 2004 | 1777 | 95.8 | ○ |
| 64 | 1468 | 1236 | 1662 | 95.4 | ○ | ◎ | −8 | 770 | 1460 | 2006 | 1775 | 95.4 | ○ |
| 17 | 1472 | 1197 | 1660 | 99.7 | ○ | ◎ | −8 | 761 | 1464 | 1958 | 1772 | 98.1 | ○ |
| 65 | 1473 | 1188 | 1660 | 99.5 | ○ | ◎ | −9 | 741 | 1464 | 1929 | 1767 | 98.0 | ○ |
| 66 | 1476 | 1179 | 1661 | 99.6 | ○ | ◎ | −11 | 720 | 1465 | 1899 | 1763 | 98.0 | ○ |
| 67 | 1472 | 1211 | 1662 | 99.5 | ○ | ◎ | −8 | 747 | 1464 | 1958 | 1772 | 98.2 | ○ |
| 68 | 1471 | 1205 | 1660 | 99.3 | ○ | ◎ | −7 | 754 | 1464 | 1959 | 1772 | 97.9 | ○ |
| 17 | 1472 | 1197 | 1660 | 99.7 | ○ | ◎ | −8 | 761 | 1464 | 1958 | 1772 | 98.1 | ○ |
| 70 | 1472 | 1179 | 1657 | 99.5 | ○ | ◎ | −7 | 784 | 1465 | 1963 | 1773 | 98.0 | ○ |
| 71 | 1471 | 1166 | 1654 | 99.2 | ○ | ◎ | −8 | 791 | 1463 | 1957 | 1770 | 98.0 | ○ |
| 72 | 1472 | 1208 | 1662 | 99.8 | ○ | ◎ | −7 | 780 | 1465 | 1988 | 1777 | 98.1 | ○ |
| 73 | 1473 | 1209 | 1663 | 99.7 | ○ | ◎ | −8 | 778 | 1465 | 1987 | 1777 | 98.2 | ○ |
| 17 | 1472 | 1197 | 1660 | 99.7 | ○ | ◎ | −8 | 761 | 1464 | 1458 | 1772 | 98.1 | ○ |
| 74 | 1472 | 1189 | 1659 | 99.6 | ○ | ◎ | −9 | 749 | 1463 | 1938 | 1767 | 98.0 | ○ |
| 75 | 1472 | 1183 | 1658 | 99.3 | ○ | ◎ | −9 | 735 | 1463 | 1918 | 1764 | 98.0 | ○ |
| 76 | 1471 | 1172 | 1655 | 99.1 | ○ | ◎ | −7 | 725 | 1464 | 1897 | 1762 | 98.0 | ○ |
| 77 | 1475 | 1174 | 1659 | 99.6 | ○ | ◎ | −7 | 760 | 1468 | 1934 | 1772 | 98.2 | ○ |
| 78 | 1473 | 1190 | 1660 | 99.6 | ○ | ◎ | −7 | 758 | 1466 | 1948 | 1772 | 98.1 | ○ |

TABLE 4-continued

| | Before Tb diffusion | | | | | | Difference due to Tb diffusion | | After Tb diffusion | | | | |
|---|---|---|---|---|---|---|---|---|---|---|---|---|---|
| Sample No. | Br (mT) | HcJ (kA/m) | PI | Hk/HcJ (%) | Br, HcJ, Hk/HcJ Evaluation | Corrosion Resistance Evaluation | ΔBr (mT) | ΔHcJ (kA/m) | Br (mT) | HcJ (kA/m) | PI | Hk/HcJ (%) | Br, HcJ, Hk/HcJ Evaluation |
| 17 | 1472 | 1197 | 1660 | 99.7 | ○ | ◎ | −8 | 761 | 1464 | 1958 | 1772 | 98.1 | ○ |
| 80 | 1471 | 1206 | 1660 | 99.7 | ○ | ◎ | −8 | 763 | 1463 | 1969 | 1772 | 98.1 | ○ |

◎ is a particularly good characteristic
○ is a good characteristic
X is a not good characteristic
* ΔBr: the difference of residual magnetic flux density Br between before and after Tb diffusion
ΔBr = (Br after Tb diffusion) − (Br before Tb diffusion)
ΔHcJ: the difference of coercive force HcJ between before and after Tb diffusion
ΔHcJ = (HcJ after Tb diffusion) − (HcJ before Tb diffusion)

TRE and "B" were varied in Table 1. Nd and Pr were included making a mass ratio of Nd to Pr to be approximately 3:1. Results are shown in Table 2. Content of each component other than TRE and "B" were varied in Table 3. In samples 77 to 80, TRE was fixed and content of Nd and Pr were varied. Results are shown in Table 4.

According to tables 1 to 4, PI, squareness ratio and the corrosion resistance before Tb diffusion were good in all the examples. In addition, PI and squareness ratio after Tb diffusion were also good in all the examples. To the contrary, according to all the comparative examples, at least one of PI before Tb diffusion, squareness ratio before Tb diffusion, PI after Tb diffusion and squareness ratio after Tb diffusion was not good.

Tb concentration distributions of the R-T-B based sintered magnets after Tb diffusion described in Tables 1 to 4 were measured using an electron probe micro analyzer, EPMA. Consequently, it was confirmed that Tb concentration reduces from outside to inside of the R-T-B based sintered magnets after Tb diffusion.

The invention claimed is:

1. An R-T-B based permanent magnet comprising an R-T-B sintered body and optionally a coating material thereon containing a heavy rare earth element not subjected to grain boundary diffusion heat treatment wherein, R is a rare earth element, T is an element other than the rare earth element, B, C, O or N, and B is boron, T at least includes Fe, Cu, Co and Ga, wherein in the R-T-B sintered body, a total of R content is 28.0 to 30.2 mass %, Cu content is 0.04 to 0.50 mass %, Co content is 1.0 to 3.0 mass %, Ga content is 0.08 to 0.30 mass %, and B content is 0.85 to 0.95 mass %, relative to 100 mass % of a total mass of R, T and B, the R-T-B sintered body further includes O, O content is 350 ppm or more and 800 ppm or less, relative to a total mass of the R-T-B based permanent magnet, an atomic ratio of 14B/(Fe+Co) is more than zero and 1.01 or less, R optionally includes a heavy rare earth element which is at least one of Tb and Dy and in a total amount of 0.5 mass % or less when present, the R-T-B sintered body has a potential index of from 1,635 or more to 1,673 and a squareness ratio of from 97% to 99.8%, wherein potential index is defined as $PI=Br+25\times HcJ\times 4\pi/2{,}000$; Br is a magnitude of a residual magnetic flux density measured by mT unit and HcJ is a coercive force measured by kA/m unit, wherein the R-T-B sintered body has the following properties when coated with the coating material and the coated R-T-B sintered body is heat treated to effect grain boundary diffusion of the heavy rare earth element such that a concentration of the heavy rare earth element is reduced from outside to inside:

the magnet has a potential index of from 1,745 to 1,781 and a squareness ratio of from 90% to 99.1%.

2. The R-T-B based permanent magnet according to claim 1, wherein the total of R content is 29.2 to 30.2 mass %.

3. The R-T-B based permanent magnet according to claim 1, wherein

R at least includes Nd.

4. The R-T-B based permanent magnet according to claim 1, wherein

R at least includes Pr and

Pr content is more than zero to 10.0 mass % or less.

5. The R-T-B based permanent magnet according to claim 1, wherein

R at least includes Nd and Pr.

6. The R-T-B based permanent magnet according to claim 1, wherein

T further includes Al and

Al content is 0.15 to 0.30 mass %.

7. The R-T-B based permanent magnet according to claim 1, wherein

T further includes Zr and

Zr content is 0.10 to 0.30 mass %.

8. The R-T-B based permanent magnet according to claim 1, further including C and C content is 1100 ppm or less relative to a total mass of the R-T-B based permanent magnet.

9. The R-T-B based permanent magnet according to claim 1, further including N and N content is 1000 ppm or less relative to a total mass of the R-T-B based permanent magnet.

10. The R-T-B based permanent magnet according to claim 1, wherein an atomic ratio of TRE/B is 2.2 to 2.7, where TRE is the total of R content.

11. The R-T-B based permanent magnet according to claim 1, wherein the heavy rare earth element is present in the R-T-B sintered body.

12. The R-T-B based permanent magnet according to claim 1, wherein the heavy rare earth element is not present in the R-T-B sintered body.

13. The R-T-B based permanent magnet according to claim 1, wherein the Ga content is 0.10 mass % or more and 0.30 mass % or less.

14. An R-T-B based permanent magnet comprising an R-T-B sintered body, wherein, R is a rare earth element, T is an element other than the rare earth element, B, C, O or N, and B is boron, T at least includes Fe, Cu, Co and Ga, a total of R content is 28.0 to 30.2 mass %, Cu content is 0.04 to 0.50 mass %, Co content is 1.0 to 3.0 mass %, Ga content is 0.08 to 0.30 mass %, and B content is 0.85 to 0.95 mass %, relative to 100 mass % of a total mass of R, T and B, the R-T-B based permanent magnet further includes O, O content is 350 ppm or more and 800 ppm or less, relative to a total mass of the R-T-B based permanent magnet, an atomic ratio of 14B/(Fe+Co) is more than zero and 1.01 or less, R includes a heavy rare earth element which is at least one of Tb and Dy and in a total amount of no greater than 0.5 mass %, and the magnet has a potential index of from 1,635 to 1,673 and a squareness ratio of from 97% to 99.8%, wherein the potential index is defined a $PI=Br+25\times HcJ\times 4\pi/2,000$: Br ia a magnitude of a residual magnetic flux density measured by mT unit and HcJ is a coercive force measured by kA/m unit.

15. The R-T-B based permanent magnet according to claim 14, wherein the total of R content is 29.2 to 30.2 mass %.

16. The R-T-B based permanent magnet according to claim 14, wherein

R at least includes Nd.

17. The R-T-B based permanent magnet according to claim 14, wherein

R at least includes Pr and

Pr content is more than zero to 10.0 mass % or less.

18. The R-T-B based permanent magnet according to claim 14, wherein

R at least includes Nd and Pr.

19. The R-T-B based permanent magnet according to claim 14, wherein

T further includes Al and

Al content is 0.15 to 0.30 mass %.

20. The R-T-B based permanent magnet according to claim 14, wherein

T further includes Zr and

Zr content is 0.10 to 0.30 mass %.

21. The R-T-B based permanent magnet according to claim 14, further including C and C content is 1100 ppm or less relative to a total mass of the R-T-B based permanent magnet.

22. The R-T-B based permanent magnet according to claim 14, further including N and N content is 1000 ppm or less relative to a total mass of the R-T-B based permanent magnet.

23. The R-T-B based permanent magnet according to claim 14, wherein an atomic ratio of TRE/B is 2.2 to 2.7, where TRE is the total of R content.

24. The R-T-B based permanent magnet according to claim 14, wherein the heavy rare earth element, prior to diffusion heat treatment, is present only as a coating on the R-T-B based permanent magnet.

25. The R-T-B based permanent magnet according to claim 14, wherein the heavy rare earth element, prior to diffusion heat treatment, is present both as a coating on the R-T-B based permanent magnet and uniformly present in the R-T-B based permanent magnet.

26. The R-T-B based permanent magnet according to claim 14, wherein the Ga content is 0.10 mass % or more and 0.30 mass % or less.

* * * * *